US006913171B2

(12) United States Patent
Carter

(10) Patent No.: US 6,913,171 B2
(45) Date of Patent: Jul. 5, 2005

(54) BOTTOM PULLING BELT FOR FOLDING MACHINE

(75) Inventor: Stephen P. Carter, Galivants Ferry, SC (US)

(73) Assignee: M&R Printing Equipment, Inc., Glen Ellyn, IL (US)

( * ) Notice: Subject to any disclaimer, the term of this patent is extended or adjusted under 35 U.S.C. 154(b) by 135 days.

(21) Appl. No.: 10/409,292

(22) Filed: Apr. 8, 2003

(65) Prior Publication Data

US 2003/0189070 A1 Oct. 9, 2003

Related U.S. Application Data

(63) Continuation-in-part of application No. 09/865,723, filed on May 29, 2001, now abandoned.
(60) Provisional application No. 60/208,567, filed on Jun. 2, 2000.

(51) Int. Cl.[7] ..... A41H 33/00
(52) U.S. Cl. ..... 223/37
(58) Field of Search ..... 223/47, 37, 38; 270/41

(56) References Cited

U.S. PATENT DOCUMENTS

| | | | |
|---|---|---|---|
| 3,310,207 | A | 3/1967 | Gore |
| 3,462,138 | A | 8/1969 | Grantham |
| 3,790,156 | A | 2/1974 | Hogendyk |
| 3,806,007 | A | 4/1974 | Grantham |
| 3,828,989 | A | 8/1974 | Heater |
| 3,984,036 | A | 10/1976 | Fritschi |
| 4,106,260 | A | 8/1978 | King |
| 4,234,179 | A | 11/1980 | Weir |
| 4,460,111 | A | 7/1984 | Nakahira |
| 4,526,115 | A | 7/1985 | Kosrow et al. |
| 4,682,977 | A | 7/1987 | Buxton |
| 4,694,978 | A | 9/1987 | Westphal et al. |
| 4,961,565 | A | 10/1990 | Karolyi |
| 4,996,861 | A | 3/1991 | Kellum |

*Primary Examiner*—John J. Calvert
*Assistant Examiner*—James G Smith
(74) *Attorney, Agent, or Firm*—Wallenstein Wagner & Rockey, Ltd.

(57) ABSTRACT

An apparatus for automatically folding garments while preventing garment retrograde is disclosed and claimed. The present invention is preferably embodied having a first conveyor surface comprised of at least a single continuous belt supported by at least two rollers, and a second conveyor surface comprised of at least a single continuous belt supported by at least two rollers, the second conveyor surface being spaced a distance from and aligned parallel and superior to the first conveyor surface to create a garment pathway therebetween, the spaced distance being sufficient to allow each surface to contact a garment passing through the pathway. A folding plate assembly is preferably positioned within the garment pathway, between a garment inlet positioned at a first end of the garment pathway and a garment outlet positioned at the opposite end of the garment pathway. A garment entering the apparatus at the inlet is contacted and moved by both conveyor surfaces through the garment pathway and is acted on by the folding plate assembly before being then discharged from the garment pathway at the garment outlet as a folded garment.

16 Claims, 3 Drawing Sheets

BOTTOM PULLING BELT FOR FOLDING MACHINE

CROSS-REFERENCE TO RELATED APPLICATION

This application is a continuation-in-part of U.S. patent application Ser. No. 09/865,723, filed May 29, 2001 now abandoned, which in turn claims the benefit of U.S. Provisional Patent Application No. 60/208,567, filed Jun. 2, 2000.

TECHNICAL FIELD OF THE INVENTION

The present invention relates generally to a conveyor system for moving garments between locations. More specifically, the present invention relates to a conveyor system for moving garments through a folding operation without garment retrograde which produces garment deformations or ripplings hazardous to machine operation.

BACKGROUND OF THE INVENTION

Various different garment folding machines are available in the relevant market which purport to minimize garment rippling and the like, but are known to jam conveyor systems or negatively affect an operation's output. As with any production driven operation, down time is critical to an operation which determines profit based to any extent on the principle of mass production. When garments become trapped within garment folding machinery a number of factors such as maintenance repair costs, contractual production delays, etc. contribute to the many losses in the market. This is particularly commonplace in the competitive textile markets. As it relates to garment folding machines or machinery which utilize a conveyor transport principle which pushes garments from above through a series of folding plates, garment rippling has been a major cause for down-time and, subsequently, a contributing element to profit losses.

An improved garment folding machine which utilizes a pulling belt technique, as herein described, has been lacking in the industry as a means to alleviate the aforementioned problems.

For example, U.S. Pat. No. 4,106,260, issued to King, discloses an article folding and packaging system for folding and packaging articles such as towels or T-shirts, wherein the article is partially folded over a cardboard insert and conveyed along a path at a selected speed through various folding locations until the article is folded, flattened, pressed, rotated if necessary, and inserted into a bag which is subsequently sealed. The apparatus for performing such function includes a reciprocating entry section for receiving one or more articles. The '260 patent teaches only a single, upper conveyor for moving garments into the folding machine.

U.S. Pat. No. 3,806,007 to Grantham, discusses a folder for folding garments such as T-shirts, with means for inserting cards in the T-shirts and folding the T-shirts about the cards; means for placing a group, such as three, folded T-shirts in a package and selectively inserting cards in one or more of the T-shirts in such package in the formation thereof. The teaching of the '007 patent is also limited to an upper belt conveyor used to move garments into the folding machine.

U.S. Pat. No. 3,310,207, issued to Gore, discloses a single feed belt apparatus for averting and folding a pillowcase, bag, or the like. The disclosed apparatus comprises means for averting the pillowcase from the wrong-side-out position to a right-side-out position, and first and second conveyor means. However, these two conveyor means are arranged to cooperate in series not in parallel.

U.S. Pat. No. 3,828,989, issued to Heater, discusses a single conveyor belt apparatus for folding a T-shirt or other textile articles, the article is folded in from opposite sides over the top of guide plates by overlying folding plates with inner folding edges that converge toward one another. The single conveyor feeds the shirt into the folding plates from below only.

Finally, U.S. Pat. No. 4,526,115 to Kosrow et al. is directed to a method and apparatus for forming a shirt sleeve. The disclosed invention utilizes a single conveyor for feeding material to a serving station.

None of the above inventions and patents, taken either singly or in combination, is seen to describe the instant invention as claimed.

SUMMARY OF THE INVENTION

The garment pulling belt, according to the present invention, provides an improved inlet means for supplying a garment to conventional garment folding machines. Folding machines currently in use generally include an inlet apparatus wherein a single belt frictionally engages with the material substrate of the garment being folded in order to carry the garment through a folding plate assembly. However, the garment pulling belt assembly of the present invention provides two individual garment pulling belts in spaced apart relation to each other to ensure proper folding without garment retrograde. As in conventional machines, the folding unit includes at least one folding blade located under the garment pulling belt.

The garment folding machine according to the invention provides a solution to the problem of garment retrograde by providing a tunnel belt which allows the material to be pulled from the bottom as well as from the top. This eliminates any stoppage of material as well as eliminates any problem due to the texture of the bottom surface. The dual belt system is supported by a frame which may be rigidly connected to the underlying support plate of the machine and is supported by a plurality of rollers. Each of the support rollers is mounted with an axis of rotation extending perpendicular to the length of the belts. In conventional folding machines, human intervention is required to make adjustments by adding weight to the belt or pushing upwards on the underlying support plate. The garment inlet includes a belt system running on rollers driven by a suitable driver such as a motor.

Each belt is supported by a plurality of rollers, the lower belt is synchronized with the upper belt. The top belt preferably includes first and second rollers with the bottom belt moving in a continuous clockwise rotation, while the upper belt moves in counterclockwise rotation. However, the lower conveyer is somewhat longer in its run, passing on its return trip through a tube, which extends along the entire length of the folding section of the machine. It is followed by a pair of stabilizing guide rollers, which allows the belt to extend first downwardly and then upwardly before returning through the folding section of the apparatus of the invention. The tube ensures that garments will not be caught up in the conveyor belt on its return trip.

Accordingly, it is a principal object of the invention to provide an improved apparatus for folding textiles.

It is another object of the invention to provide a more efficient infeed system for garment folding machines.

It is a further object of the invention to provide an infeed system for a garment folding machine which requires less adjustments, is easier to operate, and practically eliminates the tearing off of hangtags.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The detailed description of the present invention can be more readily understood with reference to the appended drawing figures, where.

Similar reference characters denote corresponding features consistently throughout the attached drawings.

DETAILED DESCRIPTION OF THE PREFERRED EMBODIMENTS

While the invention is susceptible of embodiment in many different forms, this disclosure will describe in detail preferred embodiments of the invention with the understanding that the present disclosure is to be considered as an exemplification of the principles of the invention and is not intended to limit the broad aspect of the invention to the embodiments illustrated.

The term "garment" is shown in the accompanying drawings and described below as a shirt or T-shirt. However, this is to be considered exemplary only. The definition of the term "garment" for purposes of this application includes any article made from a flexible material, such as cloth, paper, some plastics, or the like, which articles are capable of being folded to any degree along a line. Several suitable examples of these articles include shirts, sweaters, sweatshirts, pants, flags, banners, display panels, paper, plastic and cloth sheets, bedding, and the like, each of which could possibly benefit from the advantages of the present invention. Accordingly, the present invention involves methods and apparatus for automatically folding a number of foldable articles.

Figure 1:
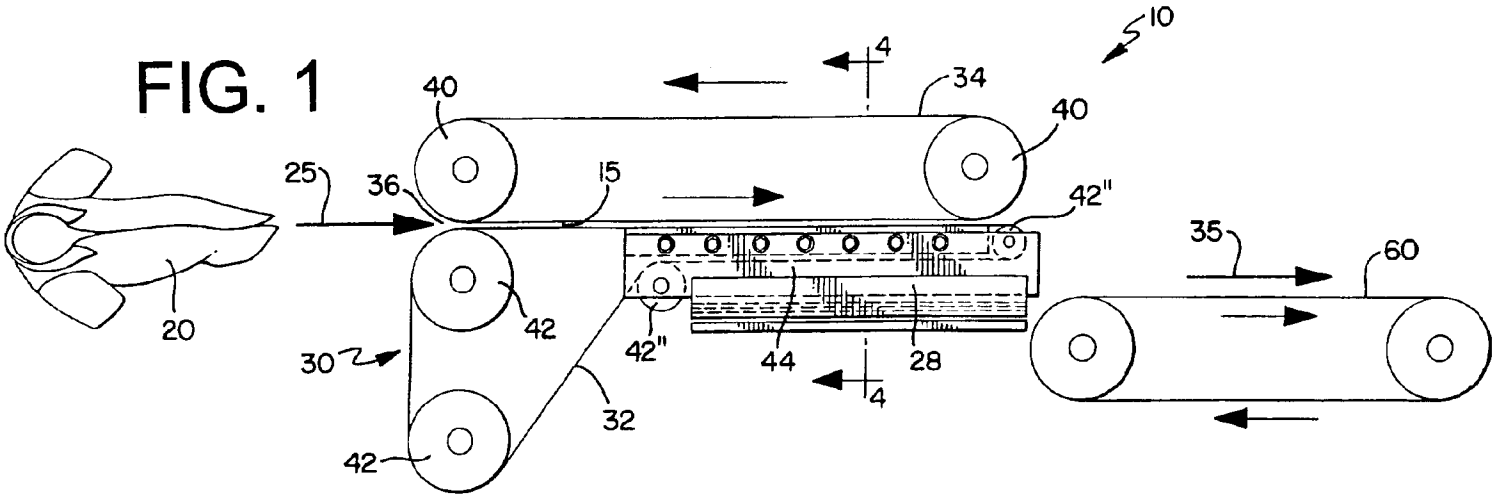
FIG. 1 is a side view of a garment folding machine featuring a bottom pulling belt assembly in accordance with one embodiment of the present invention.
Figure 2:
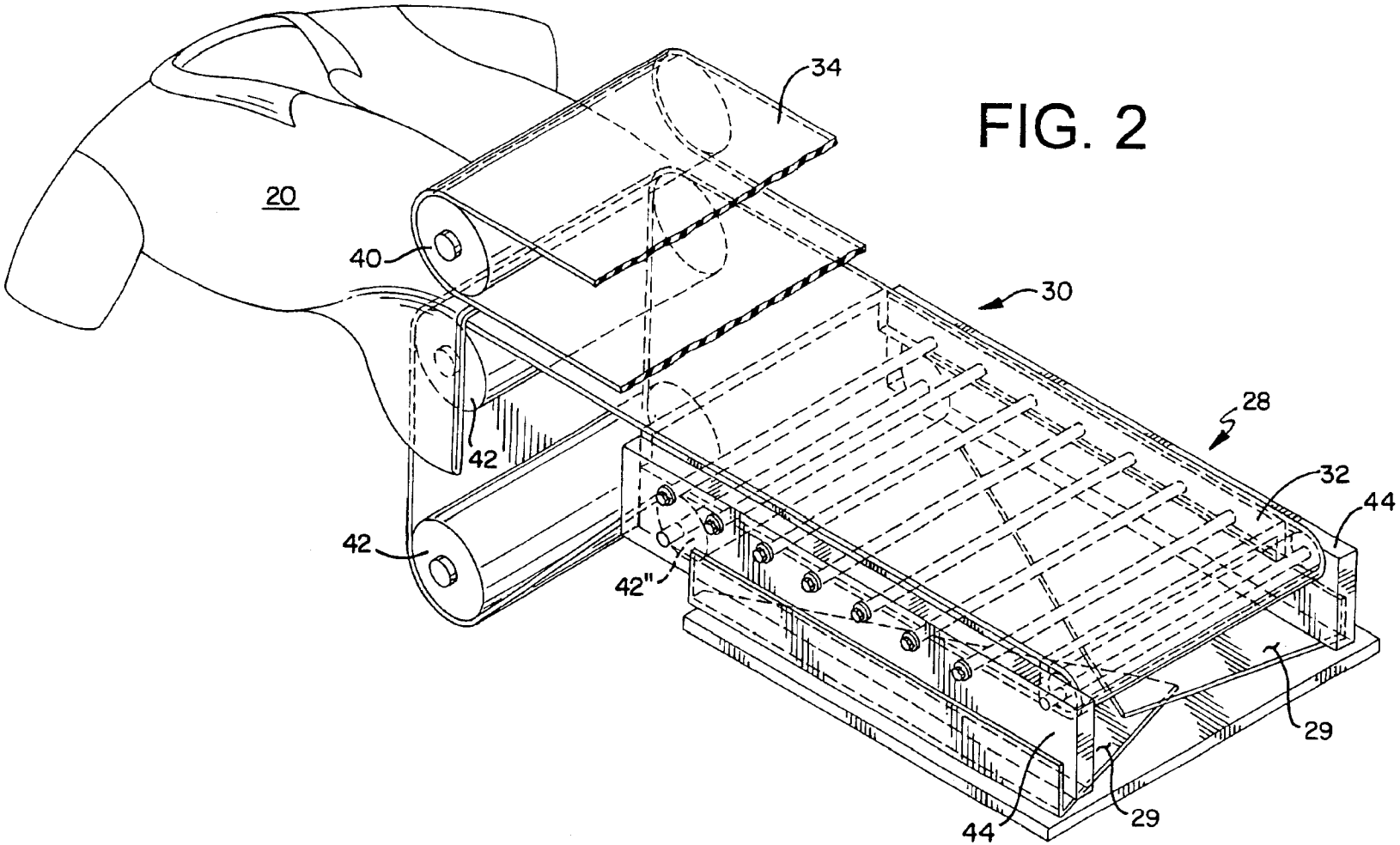
FIG. 2 is a perspective view of the bottom pulling belt assembly, including a tucker plate assembly of a garment folding machine.

The present invention 10 is directed to a garment pulling belt for garment folding machines. A preferred embodiment of the invention 10 is depicted in FIGS. 1, 2, and 4, and a prior art reference 50, over which the present invention is an improvement, is depicted in FIG. 3.

Figure 3:
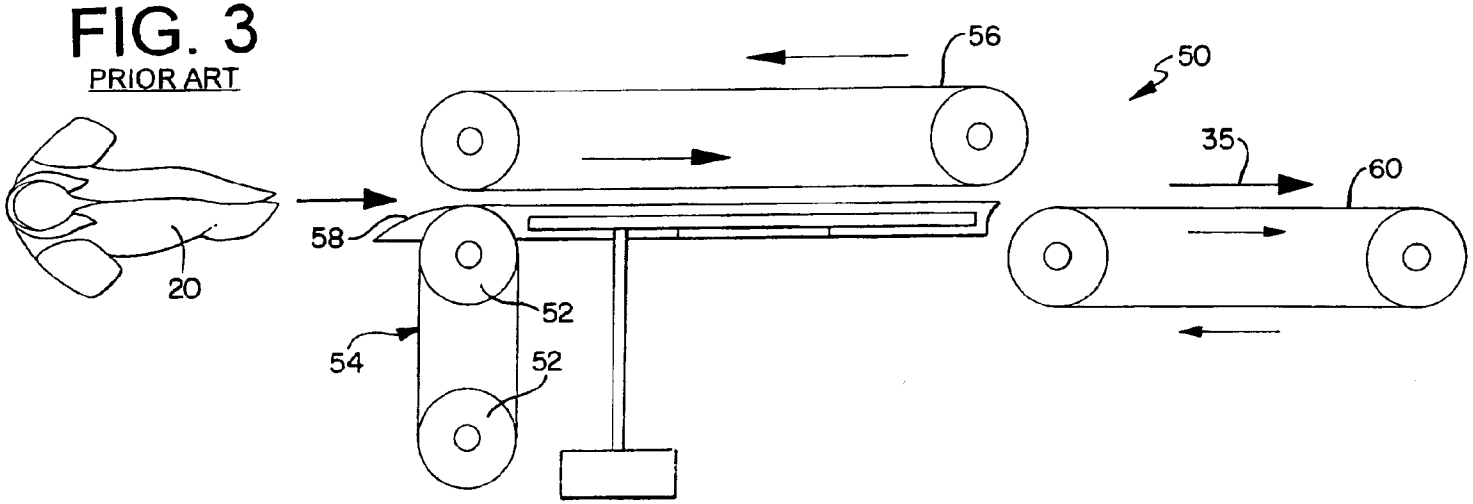
FIG. 3 PRIOR ART
FIG. 3 is a side view of a prior art machine for garment folding and packaging.
Figure 4:
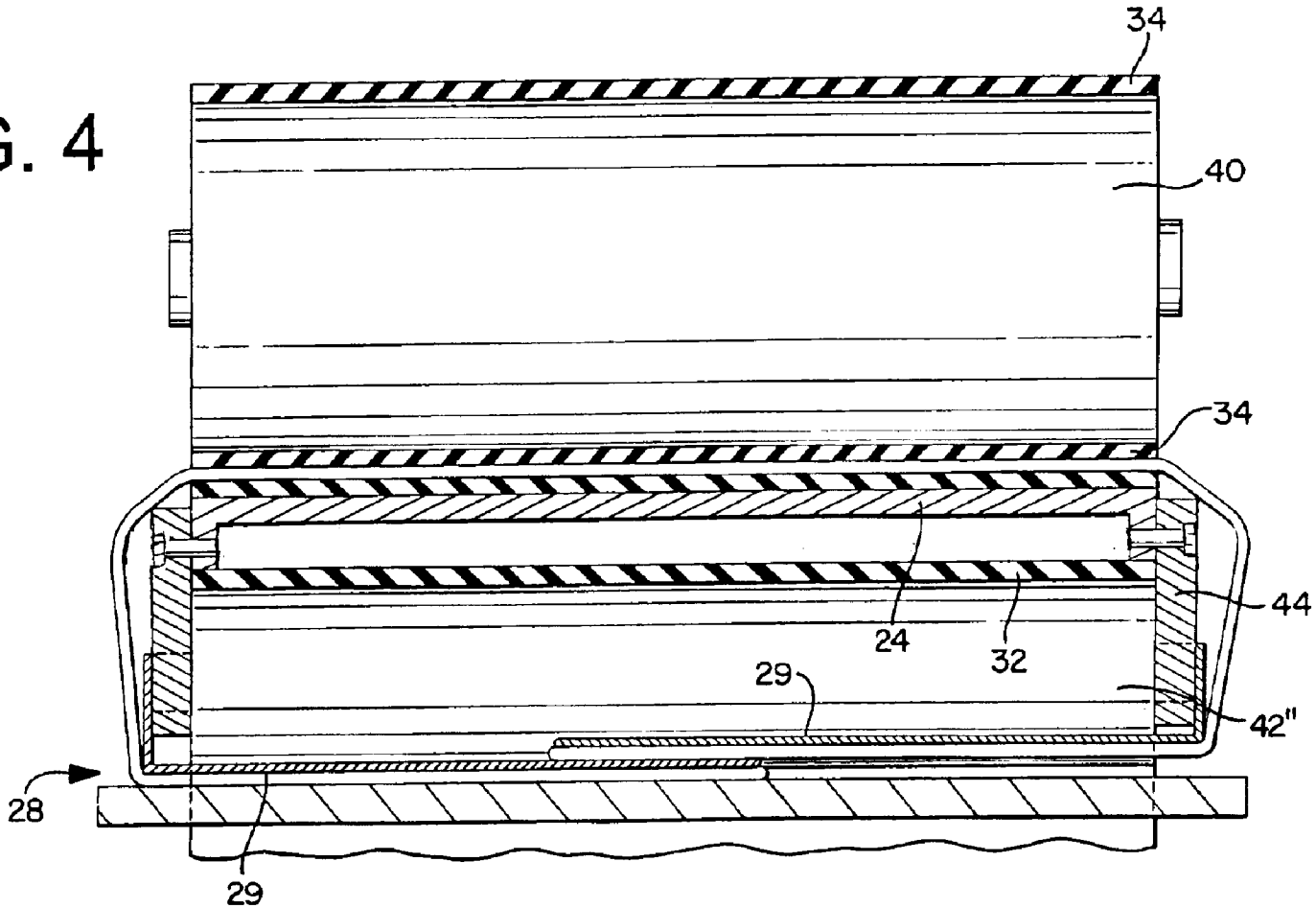
FIG. 4 is an enlarged rear view of the bottom pulling belt, upper belt, support surface, and tucker plates, according to one embodiment of the present invention.

Machines currently in use, such as the apparatus 50 depicted in FIG. 3, generally include an inlet 58 wherein a single belt 56 is responsible for frictionally engaging a material substrate of the garment 20 being folded in order to carry the garment 20 across a support surface 24 and through a folding plate assembly (not shown). However, as the garment 20 encounters the folding plate assembly it may tend to retrograde or bunch below the support surface 24 and ripple the material at the point of frictional engagement. Garment retrograde and rippling are conditions which can be particularly problematic with ink-screened garments, such as novelty T-shirts and the like, as the cured ink tends to facilitate sticking to the support surface 24. Both of these conditions can cause undesirable machine jamming, garment damage, and lost production time.

Conventional apparatuses are generally adapted to operate continuously at a pre-selected speed. One such conventional folding machine is disclosed in U.S. Pat. No. 4,106,260 to King, the disclosure of which is incorporated herein by reference. Garments, such as T-shirts or the like, are inserted into the machine section for longitudinally folding by folded plates located therein. Support is typically provided below the upper belt feed for supporting a cardboard insert and any T-shirts fed into the machine. The support may comprise a thin, polished, TEFLON® or metallic plate around which the shirt is folded. The polished plate is generally supported by a central platform attached to the machine frame. The central platform is positioned adjacent the vertical feed belts and the folding plates secured thereto in a cantilevered fashion downstream of the machine for the entire length of the article folding blades, which are dimensioned to receive and progressively fold the T-shirt as it is advanced by the belt. After being folded, the T-shirt may then be deposited upon, for example, a displaceable feed tray by a feed conveyor to carry the T-shirt to parts of the machine to be finished.

A frequent problem arises in conventionally available machines in that, due to the frictional effects of the material substrate of the garments with the belts of the machine, material with a rough or sticky bottom tends to get bunched up in the machine. Also at the infeed or inlet section or means, any hangtags on the material of the garment have a tendency to be torn off. Furthermore, the larger the garment the harder it is to fold due to the amount of material that has to be folded. A portion of the material can become stuck while the rest of the garment continues to go through the machine. This can damage the material or cause it to be misfolded.

As diagrammatically illustrated in FIG. 1, the present invention 10 improves on the conventional folding machine by featuring garment pulling belt assembly 30. Accordingly, with reference to FIGS. 1, 2 and 4, the present garment pulling belt assembly 30 comprises a second or garment pulling belt 32, for pulling garments at a second frictionally engaged surface material of the garment 20.

A preferred embodiment of the present invention 10 comprises an inlet 36 for feeding a garment 20 to a garment folding plate assembly (not shown) including tucker plate 28, the inlet 36 then directing the garment 20 into a first folding path 25. The first folding path 25 is preferably bound by an upper belt 34 fastened about a series of rollers 40 and the additional lower garment pulling belt 32 fastened about another series of rollers 42 and 42". The first folding path 25 may also be positioned to extend adjacent to an additional folding path 35 where, for example, a single belt 60 may frictionally engage the garment 20 as it exits the first folding path 25 in order to carry the garment 20 through a second folding or finishing process. The upper belt 34, the lower garment pulling belt 32, and the single belt 60 each may comprise an anti-retrograde contact surface, such as any type of surface known and used by those skilled in the art.

The present invention 10 can be manufactured as either a dual belt system or as a retrofit design for conventional machines. For retrofit designs, additional belt rollers 42" may be added using side rails 44 bolted directly to a support surface. By utilizing the existing rollers 52 (FIG. 3) from the inlet feed 54 (a vertical belt assembly), a second belt (to become the second garment pulling belt 32)—much larger than the removed feed belt 54—an be attached to the machine, passing over support surface 24.

The first folding path 25 is preferably created by a spaced apart relation with respect to belts 32 and 34 having a predetermined clearance 15 therebetween. The clearance 15 being determined preferably to reduce oscillatory motions or vibrations which may contribute to garment 20 retrograde. The potential of this phenomena is further reduced wherein the garment pulling belt 32 comprises a tunnel belt. The tunnel belt, as known by those skilled in the art, is preferably a substantially rectangular material tunnel made of a light-weight plastic, composite plastic or rigid metal material.

Through the addition of the second belt 32 according to the invention 10, most adjustments which were required of garment folding machines in the past are eliminated. The garment pulling belt 32 for garment folding machines represents a solution by providing an inlet 36 which allows the material substrate of the garment to be pulled from the bottom as well as from the top by belt 32. This helps to eliminate garment retrograde and rippling especially as it might relate to problems created due to the texture of the garment's bottom surface, for example, as might be presented by ink-screened garments.

Typically, printed decals and ink-screening on garments may cause them to bunch up when passing through the folding pathway of prior art machines having only one pulling belt. The addition of the parallel garment pulling belt 32 also helps to eliminate the problem of hangtags being ripped off, as well as eliminating the need for refolding garments due to misfolds. These benefits increase the production rate.

Further, when the size of the garment 20 is increased or decreased it can take a long time to make necessary adjustments to assure a constant and consistent fold. The bottom garment pulling belt 32 helps to eliminate most adjustments as they are typically made to address slippage or stoppage of the garment 20 within the folding pathway 25. By making the garment move more smoothly through the garment folding plate assembly, a better fold is achieved.

The garment pulling belt assembly 30 is preferably supported by a frame (not shown) which is also preferably rigidly connected to the underlying support surface 24 of the present folding machine 10. Each belt is to be supported by a plurality of rollers. Each of the support rollers is mounted with an axis of rotation extending perpendicular to the length of the belts. The top belt preferably runs on two rollers, while the bottom belt preferably runs on four rollers. However, any number of suitable rollers may be utilized for either of the pulling belts.

The inlet 36 includes pulling belt 32 running on rollers 42 and 42" driven by a suitable driver such as a motor (not shown). The motor may also drive other elements of the machine. As in conventional machines, the folding unit includes at least one folding blade 29 (FIG. 4). The second belt 32 is preferably synchronized with the upper belt 34, such that the second belt 32 moves in a continuous clockwise rotation, while the upper belt 34 moves in a counterclockwise rotation, as indicated by the arrows in FIG. 1. However, the lower conveyer is preferably somewhat longer in its run to deliver folded garments to the single belt 60 of additional folding pathway 35. The return path of second belt 32 may pass through the tunnel created by side rails 44 to help prevent garments from being caught up in the belt 32 on its return trip. The garment 20 is folded about this formed tunnel and slid off the end onto single belt 60.

It is to be understood that the present invention is not limited to the sole embodiments described above, but encompasses any and all embodiments within the scope of the following claims.

I claim:

1. An apparatus for automatically folding garments, the apparatus comprising:

a folding plate assembly;

a garment inlet for feeding garments into the folding plate assembly;

a pathway adjacent the garment inlet and leading over the folding plate assembly, the pathway being defined by a first conveyor surface and an oppositely positioned second conveyor surface, wherein the first and second conveyor surfaces are spaced at a distance sufficient to allow contact by both surfaces of a garment within the pathway.

2. The apparatus of claim 1, wherein the first and second conveyor surfaces are positioned within the pathway to engage opposing portions of the garment.

3. The apparatus of claim 1, wherein the first and second conveyor surfaces move at substantially identical rates.

4. The apparatus of claim 1, further comprising a means for preventing garment retrograde within the pathway.

5. The apparatus of claim 4, wherein the means for preventing garment retrograde comprises movement of the first and second conveyor surfaces at substantially identical rates.

6. The apparatus of claim 1, wherein the first and second conveyor surfaces are substantially parallel.

7. The apparatus of claim 1, wherein the first and second conveyor surfaces comprise an anti-retrograde contact surface.

8. The apparatus of claim 4, wherein the means for preventing garment retrograde comprises a tube surrounding a portion of a return side of the first conveyor surface parallel to the garment pathway.

9. The apparatus of claim 4, wherein said first conveyor surface is supported by rollers mounted with an axis of rotation extending perpendicular to the length of the first and second conveyor surfaces and pushing upwards on an underlying support plate, and wherein said surfaces are driven by a set of synchronized motor driven rollers.

10. An apparatus for automatically folding garments comprising:

a first conveyor surface comprised of at least a single continuous belt supported by at least two rollers;

a second conveyor surface comprised of at least a single continuous belt supported by at least two rollers, the second conveyor surface being spaced a distance from and aligned parallel and superior to the first conveyor surface to create a garment pathway therebetween, the spaced distance being sufficient to allow each surface to contact a garment passing along the pathway;

a folding plate assembly positioned below the garment pathway;

a garment inlet positioned at a first end of the garment pathway; and a garment outlet positioned at an end of the garment pathway opposite the garment inlet, whereby a garment entering the apparatus at the inlet is contacted and moved by both conveyor surfaces through the garment pathway to be acted on by the folding plate assembly and then discharged from the garment pathway at the garment outlet as a folded garment.

11. The apparatus of claim 10, wherein the first and second conveyor surfaces move at substantially identical rates.

12. The apparatus of claim 10, wherein the first and second conveyor surfaces comprise an anti-retrograde contact surface.

13. An apparatus for retrofitting to a garment folding machine having a garment folding plate assembly, an upper pulling belt and a surface parallel to and spaced from the belt to thereby together define a folding pathway which passes over the folding plate assembly, the apparatus comprising:

a second pulling belt assembly comprising a continuous belt configured to pass over the folding plate assembly between the surface and the upper pulling belt.

14. The apparatus of claim 13, wherein the second pulling belt assembly further comprises at least one roller for supporting the continuous belt about the surface.

15. The apparatus of claim 14, wherein the second pulling belt assembly further comprises a pair of rails attached to opposing sides of the surface and retaining the at least one roller in a position to permit the continuous belt to pass over the surface.

16. The apparatus of claim 13, wherein the continuous belt is a tunnel belt.

* * * * *